US007074142B2

(12) United States Patent
Takeuchi et al.

(10) Patent No.: US 7,074,142 B2
(45) Date of Patent: Jul. 11, 2006

(54) RACKET FRAME

(75) Inventors: Hiroyuki Takeuchi, Hyogo (JP); Kunio Niwa, Hyogo (JP); Takeshi Ashino, Hyogo (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/866,871

(22) Filed: Jun. 15, 2004

(65) Prior Publication Data

US 2005/0043124 A1 Feb. 24, 2005

(30) Foreign Application Priority Data

Aug. 21, 2003 (JP) ..... 2003-297540

(51) Int. Cl.
*A63B 49/02* (2006.01)

(52) U.S. Cl. ..... 473/537; 473/535

(58) Field of Classification Search ..... 473/524, 473/535–537, 539, 540
See application file for complete search history.

(56) References Cited

U.S. PATENT DOCUMENTS 5,082,266 A * 1/1992 Lo ..... 473/537
5,893,810 A * 4/1999 Umlauft ..... 473/537
6,159,114 A * 12/2000 DeGaris ..... 473/537
6,293,878 B1 * 9/2001 Iwatsubo et al. ..... 473/521
6,447,412 B1 * 9/2002 Filippini ..... 473/524
6,688,997 B1 * 2/2004 Ashino et al. ..... 473/535
2005/0043124 A1 * 2/2005 Takeuchi et al. ..... 473/535

FOREIGN PATENT DOCUMENTS

JP 2991129 B2 10/1999
JP 2000-61004 A 2/2000
JP P2001-61994 A * 3/2001
JP 3090850 U 10/2002
JP 2003-38683 A 2/2003

* cited by examiner

*Primary Examiner*—Raleigh W. Chiu
(74) *Attorney, Agent, or Firm*—Birch, Stewart, Kolasch & Birch, LLP

(57) ABSTRACT

A tennis racket frame (10), including a sleeve composed of a fiber reinforced resin, having a weight not less than 180 g nor more than 270 g, when strings are not mounted in a ball-hitting face thereof surrounded with a head part thereof. Supposing that the strings are not mounted in the ball-hitting face, a secondary natural frequency (F1) of the racket frame in an in-plane direction thereof is set to not less than 200 Hz nor more than 320 Hz, a secondary natural frequency (F2) thereof in an out-of-plane direction thereof is set to not less than 480 Hz nor more than 650 Hz, and F1/F2 is set to not less than 0.3 nor more than 0.6.

8 Claims, 8 Drawing Sheets

RACKET FRAME

This nonprovisional application claims priority under 35 U.S.C. § 119(a) on Patent Application No(s). 2003-297540 filed in Japan on Aug. 21, 2003, the entire contents of which are hereby incorporated by reference.

BACKGROUND OF THE INVENTION

1. Field of the Invention

The present invention relates to a racket frame and more particularly to a tennis racket frame which is lightweight and has an excellent durability, a high rigidity, and an improved restitution performance.

2. Description of the Related Art

In recent years, the racket frame is demanded to have a light weight, a high rigidity, a high strength, and an excellent durability. The fiber reinforced resin is the most popular material for the racket frame. Normally the racket frame is formed by molding a thermosetting resin reinforced with fibers such as carbon fiber having a high strength and elastic modulus. The fiber reinforced resin containing the thermosetting resin as the matrix resin has a high rigidity and restitution performance, but is apt to generate vibrations when fiber reinforced resin is subjected to a shock, thus causing many tennis players to suffer tennis elbow frequently.

To overcome the problem, in recent years, there is proposed a racket frame composed of a fiber reinforced thermoplastic resin containing a thermoplastic resin superior in vibration-damping performance as the matrix resin thereof and a continuous fiber as the reinforcing fiber thereof. The racket frame made of the fiber-reinforced thermoplastic resin reflects high toughness of the thermoplastic resin, thus having characteristics such as a high resistance to shock and a high vibration-damping performance that cannot be attained by the conventional racket frame made of the thermosetting resin.

However, the thermoplastic resin depends on environment for its elastic modulus and strength more than the thermosetting resin. Thus in dependence on environment in which the racket frame is used, the characteristic of the thermoplastic resin such as rigidity is liable to change.

In addition, to comply with female and senior players' demands for hitting a ball a long distance with a small power, operability and restitution performance of a racket are regarded as important. Thus the racket is desired to be more and more lightweight (decrease of moment of inertia) and have a higher restitution performance.

As means for improving the restitution performance of the racket frame, the following three methods have been adopted:

(1) The weight of the racket frame is increased to increase the moment of inertia.

(2) The area of the ball-hitting face is increased.

(3) The rigidity of the racket frame in the out-of-plane direction is increased and the rigidity in the in-plane direction is decreased.

However, the method (1) reduces the operability of the racket frame and is incapable of making it lightweight. The method of (2) increases the weight of the racket frame and hence the moment of inertia. Thereby the operability decreases. The method of (3) causes alteration of a prepreg-layered construction and the sectional configuration of the racket frame. Thus if the racket frame is so constructed as to have a high elasticity, its strength decreases. If the racket frame is constructed in consideration of its strength, its weight increases.

In the racket proposed by the present applicant and disclosed in Japanese Patent Application Laid-Open No. 2003-38683, the secondary in-plane direction natural frequency is set to not less than 340 Hz nor more than 460 Hz to provide the racket with a wide sweet area. But there is room for improvement in its restitution performance.

In the tennis racket disclosed in Japanese Patent Application Laid-Open No. 2000-61004, the diameter of the string hole at its inner peripheral-side is set large to allow strings to have a large deformation amount so that the tennis racket has an improved restitution performance. However, the strength on the periphery of the string hole decreases and thus the racket frame has a low durability. If the racket frame is constructed in consideration of its strength, its weight increases.

In the tennis racket disclosed in Patent No. 2991129, the inner peripheral surface of the racket frame is concavely formed to increase the area of the sweet area. This construction enlarges the length of the periphery of the racket frame in a vertical sectional view. Thus the weight of the racket frame increases and its durability deteriorates.

In the racket disclosed in registered Japanese Utility Model No. 3090850, the inner peripheral side of the string insertion portion is formed concavely. Thereby the racket has a low rigidity in the in-plane direction and a low face stability.

SUMMARY OF THE INVENTION

The present invention has been made in view of the above-described problems. Therefore, it is an object of the present invention to provide a racket frame having a light weight, a preferable durability, a high rigidity, and a high restitution performance.

To achieve the object, according to the present invention, there is provided a tennis racket frame including a sleeve composed of a fiber reinforced resin. The tennis racket frame has a weight not less than 180 g nor more than 270 g, with the exception of a weight of strings. Supposing that the strings are not mounted in the ball-hitting face, a secondary natural frequency (F1) of the racket frame in an in-plane direction thereof is set to not less than 200 Hz nor more than 320 Hz, a secondary natural frequency (F2) thereof in an out-of-plane direction thereof is set to not less than 480 Hz nor more than 650 Hz, and F1/F2 is set to not less than 0.3 nor more than 0.6.

The present inventors have made the present invention as a result of their energetic researches and experimental results including ball-hitting tests. That is, they have confirmed that to improve the restitution performance of a lightweight tennis racket, it is effective to make the natural frequency of the string proximate to the secondary out-of-plane direction natural frequency (F2) of the racket frame as well as the secondary in-plane direction natural frequency (F1) thereof and set the ratio of the secondary out-of-plane direction natural frequency (F2) of the racket frame to the secondary in-plane direction natural frequency (F1) thereof to not less than 0.3 nor more than 0.6.

Conceivably, the reason the restitution performance of the tennis racket is improved when the natural frequency of the string and the secondary out-of-plane direction natural frequency of the racket frame are proximate to each other is because the position of the string and the position of the secondary out-of-plane direction mode are coincident with each other. The restitution performance of the tennis racket becomes great because the vibration mode of the secondary out-of-plane direction vibration waveform and the vibration mode of the vibration waveform of the string are equal to each other in the range of the ball-hitting face of the racket. That is, it is possible to suppress an energy loss and improve the restitution performance of the tennis racket by matching (impedance matching) the secondary out-of-plane direction natural frequency of the racket frame with the natural frequency of the string.

To improve the restitution performance of the inner peripheral portion, it is necessary to consider the natural frequency of the string in a stretched state because the string is mounted on the racket frame when the tennis racket is used. However, it has become clear that the secondary in-plane direction natural frequency of the racket frame measured with the string stretched on the racket frame at a normal tension of 45–55 lbs. is higher by 300 to 400 Hz than that measured with the string unstretched thereon.

Because the secondary in-plane direction natural frequency of the racket frame increases much when the string is mounted on the racket frame, it is necessary to set the secondary in-plane direction natural frequency of the racket frame when the string is not mounted thereon lower than the natural frequency of the string in making secondary in-plane direction natural frequency of the racket frame proximate to the natural frequency of the string.

The secondary out-of-plane direction natural frequency of the racket frame measured with the string stretched thereon at the normal tension of 45–55 lbs. is lower by 2 to 3% than that measured with the string unstretched thereon. Therefore it is necessary to set the secondary out-of-plane direction natural frequency of the racket frame when the string is not mounted thereon a little higher than the natural frequency of the string.

When the string is mounted on the racket frame at the normal tension of 45–55 lbs., the natural frequency of the string is in the range from 450 Hz to 600 Hz.

To meet the above-described requirements, in the present invention, supposing that strings are not mounted in the head part of the racket frame, the secondary natural frequency (F1) of the racket frame in the in-plane direction is set to not less than 200 Hz nor more than 320 Hz, the secondary natural frequency (F2) of the racket frame in the out-of-plane direction is set to not less than 480 Hz nor more than 650 Hz, and F1/F2 is set to not less than 0.3 nor more than 0.6. That is, when the string is not mounted on the racket frame, the secondary in-plane direction natural frequency of the racket frame is set low, whereas the secondary out-of-plane direction natural frequency thereof is set high. Thus when the string is mounted on the racket frame, it is possible to make the secondary in-plane direction natural frequency thereof and the secondary out-of-plane direction natural frequency thereof proximate to the natural frequency of the string. Thereby the restitution performance of the racket frame can be improved.

When the string is not mounted on the racket frame, the secondary natural frequency (F1) in the in-plane direction thereof is set to not less than 200 Hz nor more than 320 Hz and to favorably not less than 220 Hz nor more than 300 Hz. If the secondary natural frequency (F1) in the in-plane direction is less than 200 Hz, the in-plane direction rigidity is low and the face stability deteriorates. If the secondary natural frequency (F1) in the in-plane direction is more than 320 Hz, it is impossible to make the secondary in-plane direction natural frequency of the racket frame proximate to the natural frequency of the string when the string is mounted on the racket frame. Thereby it is impossible to improve the restitution performance of the racket frame sufficiently.

On the other hand, the secondary natural frequency (F2) in the out-of-plane direction is set to not less than 480 Hz nor more than 650 Hz and to favorably not less than 500 Hz nor more than 630 Hz. If the secondary natural frequency (F2) in the out-of-plane direction is less than 480 Hz or more than 650 Hz, it is impossible to make the secondary out-of-plane direction natural frequency of the racket frame proximate to the natural frequency of the string, when the string is mounted on the racket frame. Thereby it is impossible to improve the restitution performance of the racket frame sufficiently.

The ratio of F1 to F2 is set to not less than 0.3 nor more than 0.6 and to favorably not less than 0.35 nor more than 0.55. If F1/F2 is less than 0.3 or more than 0.6, it is impossible to make the secondary in-plane direction natural frequency of the racket frame or the secondary out-of-plane direction natural frequency thereof proximate to the natural frequency of the string when the string is mounted on the racket frame. Thereby it is impossible to improve the restitution performance of the racket frame sufficiently.

The secondary in-plane direction natural frequency of the racket frame and the secondary out-of-plane direction natural frequency thereof can be adjusted by differentiating the fibrous angles of reinforcing fibers of prepregs forming the racket frame from conventional fibrous angles or by varying the width dimension, thickness dimension, and sectional configuration of the racket frame.

As the means for setting the ratio of the secondary in-plane direction natural frequency (F1) of the racket frame to the secondary out-of-plane direction natural frequency (F2) thereof to not less than 0.3 nor more than 0.6, it is preferable to form an elliptic or oblong concavity at one or more portions of the inner peripheral portion of the head part in such a way that a maximum length of the concavity in the longitudinal direction of the racket frame is smaller than a maximum length thereof in the thickness direction of the racket frame orthogonal to the longitudinal direction.

The formation of the concavity allows elongation of the length of inner periphery of the racket frame. Thereby it is possible to reduce the difference between the length of inner periphery of the racket frame and that of the periphery thereof. Hence it is possible to prevent formation of creases and hence the racket frame from cracking. That is, it is possible to increase the strength of the racket frame. Therefore it is possible to reduce the secondary in-plane direction natural frequency without altering the number of prepregs, impregnated with resin, to be layered and fibrous angle thereof, namely, without altering the basic design of the racket frame and without lowering the strength thereof. Thereby F1/F2 can be set to not less than 0.3 nor more than 0.6.

In combination with the yoke of the racket frame, the concavity is formed at four corners of the head part forming the elliptic or oblong ball-hitting face. Supposing that the ball-hitting face is regarded as a clock face and that a top position t of the ball-hitting face is 12 o'clock, the four corners are disposed in the vicinity of a 2 o'clock position, a 4 o'clock position, an 8 o'clock position, and a 10 o'clock position.

By forming the concavity on the periphery of the string hole, with the string hole disposed at the center of the concavity, it is possible to elongate the substantial effective length of the string passing through the string hole. Therefore it is possible to enhance the restitution performance of the string. Strings fitted in the string hole at the 2 o'clock position, the 4 o'clock position, the 8 o'clock position, and the 10 o'clock position are disposed on the periphery of the sweet area. Thus by enhancing the restitution performance of the string disposed on the periphery of the sweet area, it is possible to enlarge the sweet area substantially and enhance the restitution performance of the sweet area.

Instead of the corners of the ball-hitting face, the concavity may be formed in the vicinity of a three o'clock position and a nine o'clock position between which the widthwise length of the clock face is maximum. In this case, it is possible to elongate the substantial effective length of the string passing through the sweet area and enhance the restitution performance of the sweet area.

Instead of the periphery of the string hole, the concavity may be formed by recessing the inner peripheral portion of the racket frame disposed between adjacent string holes. This construction does not have any action of elongating the substantial effective length of the string. But it is possible to design the racket frame in such a way that the ratio of F1 (secondary in-plane direction natural frequency of the head part) to F2 (secondary out-of-plane direction natural frequency of the head part) is set to not less than 0.3 nor more than 0.6 without affecting the string adversely.

It is possible to use the fiber reinforced prepreg containing carbon fibers impregnated with thermosetting resin (epoxy resin) as its reinforcing fiber. As the reinforcing fiber, it is possible to use aramid fiber, boron fiber, aromatic polyamide fiber, aromatic polyester fiber, ultra-high-molecular-weight polyethylene fiber, and the like in addition to the carbon fiber.

As apparent from the foregoing description, when the string is not mounted on the racket frame, the secondary in-plane direction natural frequency of the racket frame is set low, whereas the secondary out-of-plane direction natural frequency thereof is set high. Thus when the string is mounted on the racket frame, it is possible to make the secondary in-plane direction natural frequency of the racket frame as well as the secondary out-of-plane direction natural frequency of the racket frame proximate to the natural frequency of the string. Thereby the restitution performance of the racket frame can be improved.

Since the concavity is formed on the inner peripheral surface of the head part, it is possible to elongate the length of the inner periphery of the racket frame. Thereby it is possible to reduce the difference between the length of inner periphery of the racket frame and that of the periphery thereof. Hence it is possible to prevent creases from being formed in a molding time and the racket frame from cracking. That is, it is possible to increase the strength of the racket frame. Therefore by forming the concavity on the inner peripheral surface of the head part, it is possible to adjust the secondary in-plane direction natural frequency and the secondary out-of-plane direction natural frequency without reducing the strength of the racket frame. When the concavity is formed on the periphery of the string hole, with the string hole disposed on the bottom surface of the concavity, it is possible to elongate the substantial effective length of the string. Therefore it is possible to enhance the restitution performance of the string. Thereby by forming the concavity on the periphery of the string hole formed at the corners of the head part, it is possible to enhance the restitution performance of the string on the periphery of the sweet area. Further by forming the concavity on the periphery of the string hole through which the string passing through the sweet area is inserted, it is possible to enhance the restitution performance of the string in the sweet area.

DETAILED DESCRIPTION OF THE PREFERRED EMBODIMENTS

The embodiments of the present invention will be described below with reference to the drawings.

Figure 1:
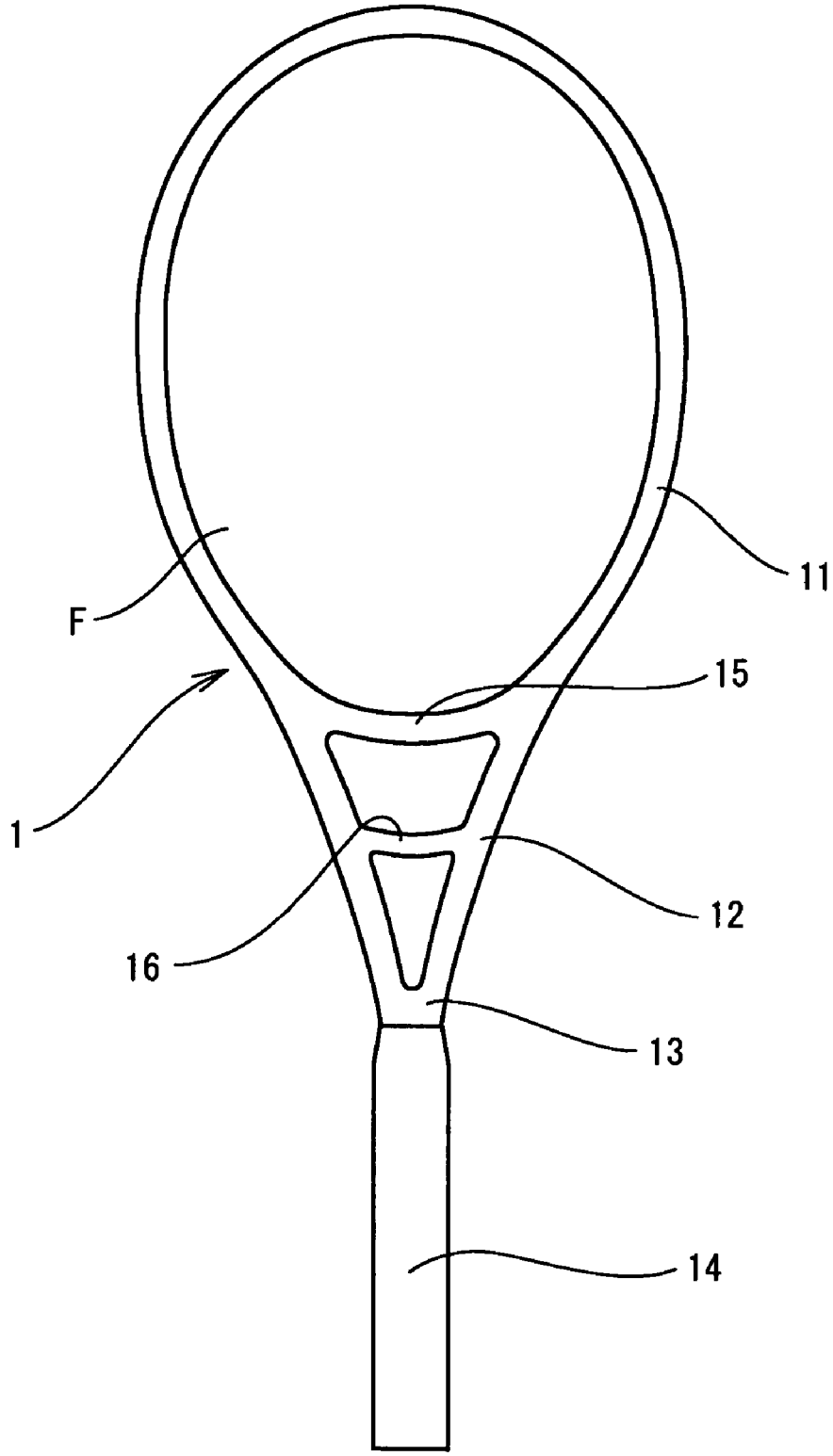
FIG. 1 is a front view showing a racket frame of an embodiment of the present invention.

FIGS. 1 and 2 show a racket frame 1 according to an embodiment of the present invention. The racket frame 1 is composed of a pipe made of fiber reinforced resinous layers. The racket frame 1 has a head part 11 surrounding a ball-hitting face F, a throat part 12, a shaft part 13, and a grip part 14. These parts 11, 12, 13, and 14 are formed continuously. A first yoke 15 is formed at one end of the throat parts 12 sandwiching the first yoke 15. A second yoke 16 is formed at approximately the center of the throat part 12 in its longitudinal direction. The elliptic ball-hitting face F is formed with the head part 11 and the first yoke 15. Strings are inserted into string holes formed in the head part 11 and mounted in the ball-hitting face F. The thickness D of the head part 11 perpendicular to the ball-hitting face F is set to 28 mm.

The racket frame 1 is formed by arranging reinforcing fibers parallel with one another to form a preform of a sleeve composed of layered prepregs impregnated with a thermosetting resin and then heating the preform inserted into the cavity of a die.

The fibrous angles of the prepregs with respect to the axial direction (longitudinal direction) of the racket frame 1 are set to 0°, 30°, and 45° in dependence on layers (prepregs). The weight ratio among the prepregs having the fibrous angles 0°, 30°, and 45° is set to 2:4:4.

Carbon fibers are used as the reinforcing fibers of the prepregs. Epoxy resin is used as the matrix resin of the fiber reinforced resin.

Figure 2A:
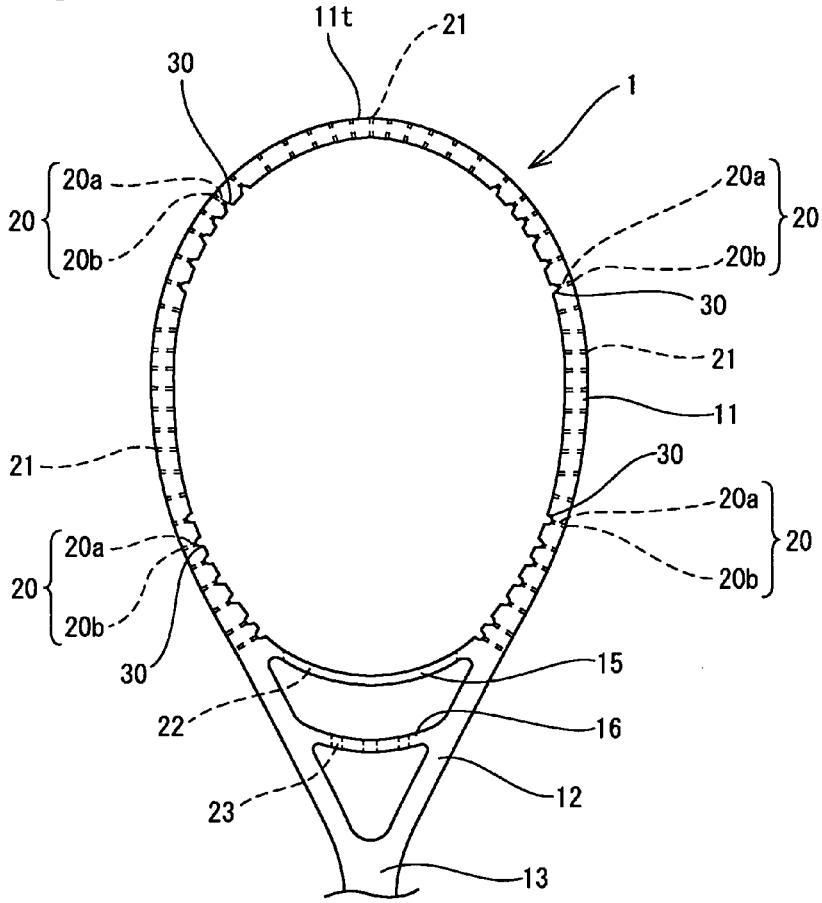
FIG. 2A is an enlarged view showing a racket frame showing main parts thereof.

With reference to FIG. 2A, let it be supposed that the elliptic ball-hitting face F is regarded as a clock face and that a top position 11*t* thereof is 12 o'clock. As shown in FIGS.

2B and 2C, in each of string holes 20 formed at and in the vicinity of four corners of the ball-hitting face F, namely, at a 2 o'clock position, a 4 o'clock position, an 8 o'clock position, and a 10 o'clock position, the diameter of an inner peripheral-side string hole 20*a* formed at an inner peripheral portion 11*a* of the head part 11 is equal to that of a peripheral-side string hole 20*b* formed at a peripheral portion 11*b* of the head part 11. A plurality of concavities 30 each having a maximum depth d set to 2 mm is formed at certain intervals around the inner peripheral-side string hole 20*a*. The depth d is the length from the bottom of the concavity 30 to an imaginary inner peripheral portion continuous with the inner peripheral portion 11*a* where the concavity 30 is not formed. This applies to the examples and the comparison examples which will be described later.

Figure 2B:
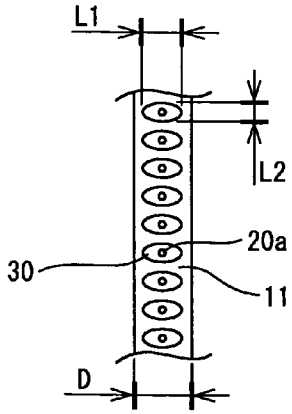
FIG. 2B shows string holes.
Figure 2C:
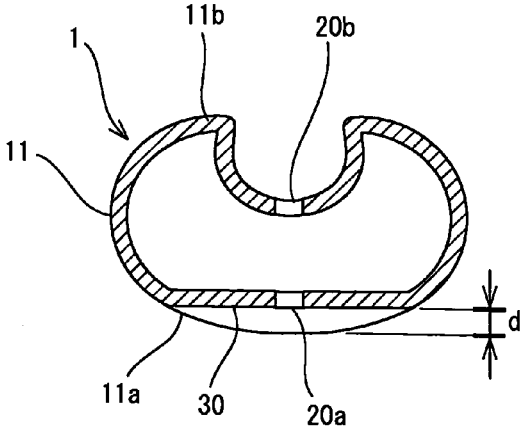
FIG. 2C is a sectional view of a position where the string hole is formed.
Figure 2D:
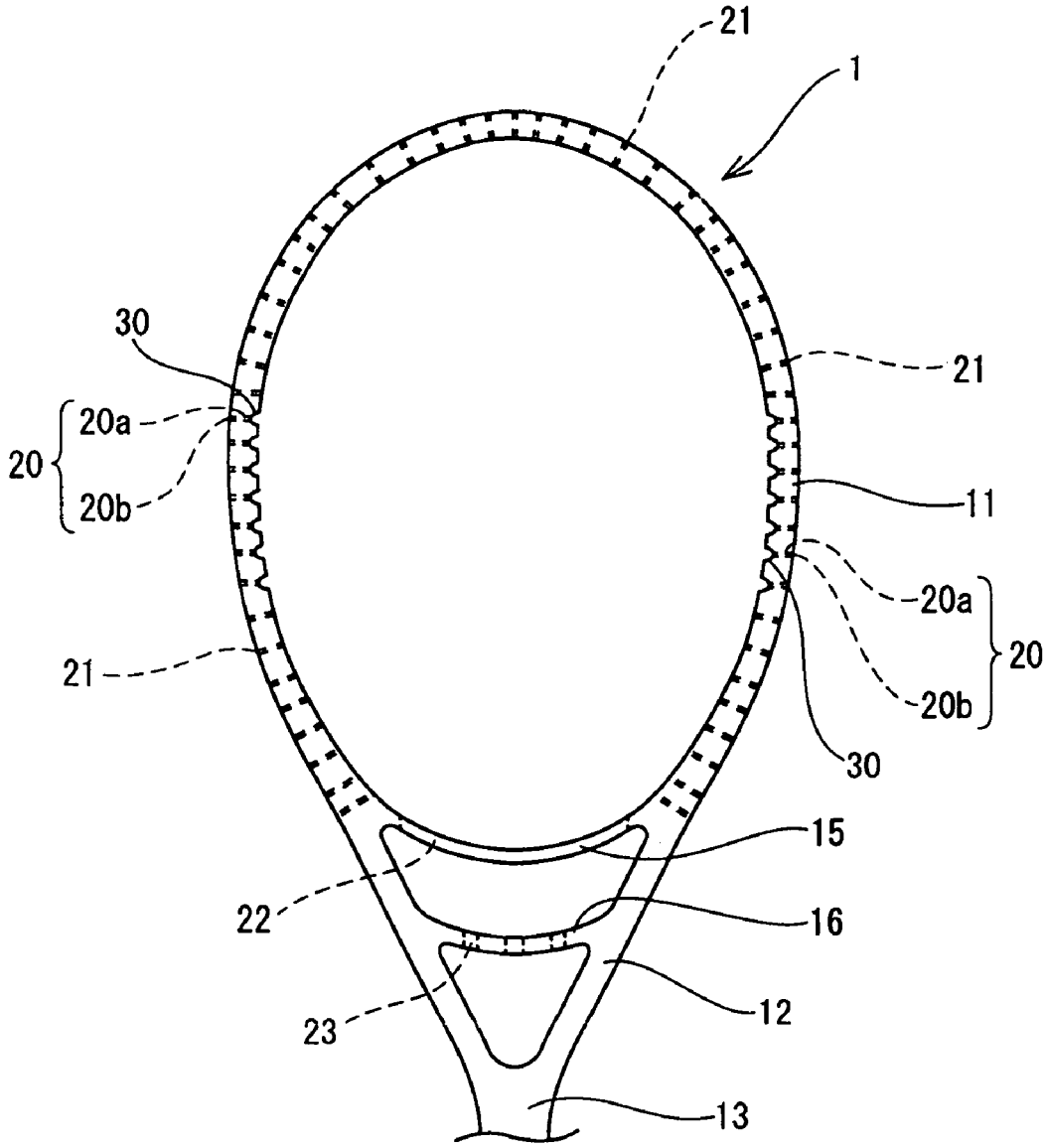
FIG. 2D is enlarged view of a racket frame showing concavites at and adjacent to 3 o'clock and 9 o'clock positions on an inner peripheral portion of the racket head.
Figure 2E:
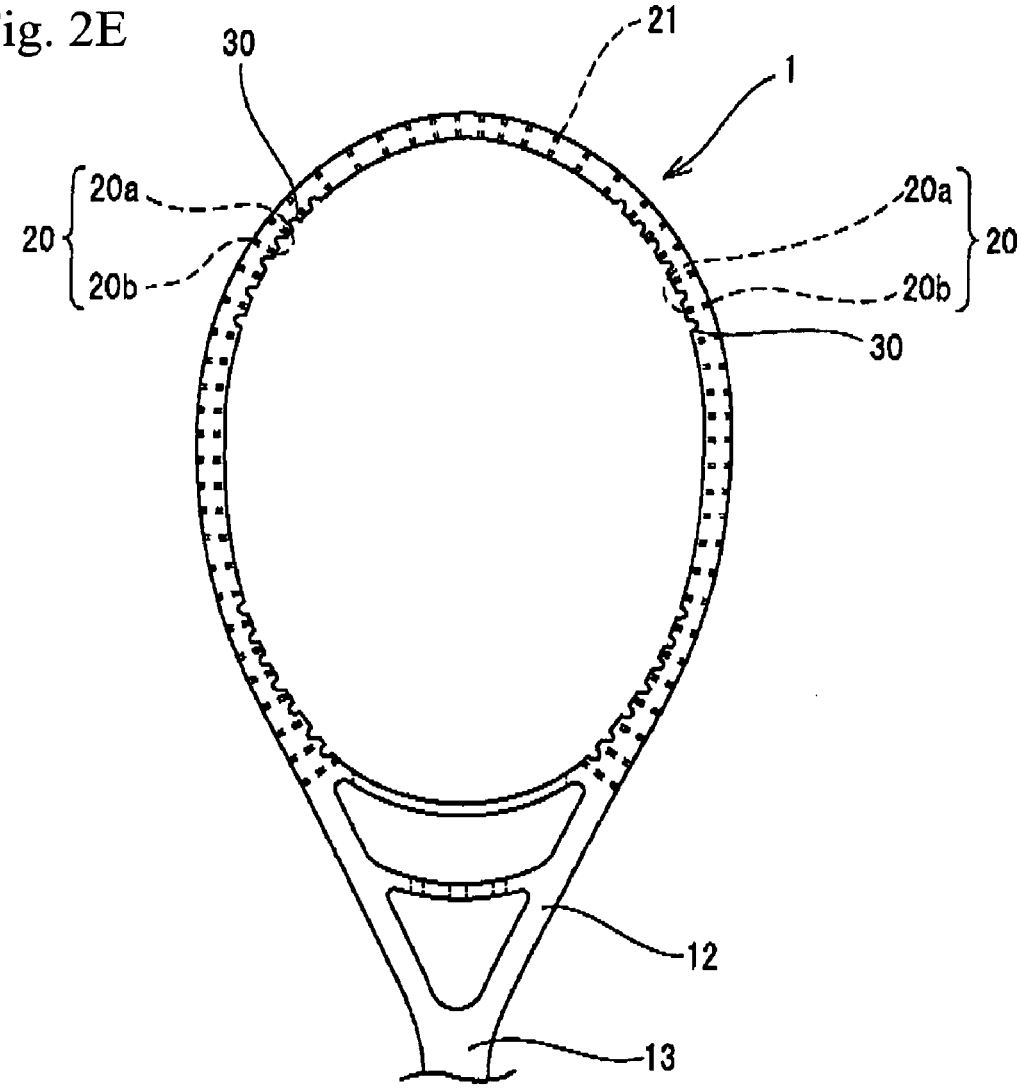
FIG. 2E is an enlarged view of a racket frame showing concavities formed between adjacent sting holes on an inner peripheral portion of the racket head.
Figure 2F:
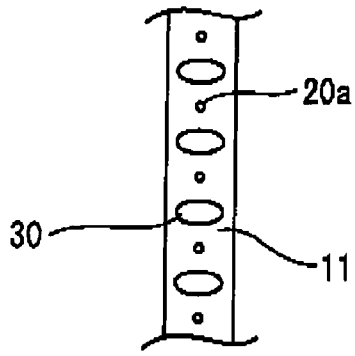
FIG. 2F is another view showing concavities formed between adjacent sting holes on an inner peripheral portion of the racket head.

As shown in FIG. 2B, the concavity 30 is elliptic and has its center at the inner peripheral-side string hole 20*a*. The direction of the major axis L1 of the concavity 30 is coincident with the direction of a thickness D of the racket frame. The direction of the minor axis L2 of the concavity 30 is coincident with the longitudinal direction of the racket frame. In this embodiment, the major axis L1 and the minor axis L2 are set to 20 mm and 10 mm respectively. The sectional configuration of the concavity 30 obtained by cutting it at a right angle to the longitudinal direction of the racket frame is approximately linear.

In a string hole 21 formed at portions of the head part 11 other than the string holes 20 formed at the four corners of the ball-hitting face F, the concavity is not formed around the inner peripheral-side string hole. One long string insertion hole 22 is formed through the first yoke 15 in the longitudinal direction of the racket frame. All strings passing through the first yoke 15 are inserted through the long string insertion hole 22. String holes 23 through which one string is inserted is formed on the second yoke 16.

The weight of the racket frame 1 is set to 246 g when strings are not mounted on the racket frame 1. The balance is set to 360 mm. When the strings are not mounted on the racket frame 1, the secondary natural frequency (hereinafter referred to as secondary in-plane natural frequency) (F1) measured in the in-plane direction of the racket frame is set to 232 Hz, and the secondary natural frequency (hereinafter referred to as secondary out-of-plane natural frequency) (F1) measured in the out-of-plane direction of the racket frame is set to 555 Hz. F1/F2 is set to 0.42.

The secondary in-plane natural frequency (F1') and the secondary out-of-plane natural frequency (F2') measured with the strings mounted on the racket frame are 550 Hz and 539 Hz respectively. The natural frequency (S) of the string is 526. The difference F3 between F1' and S, expressed in Tables 1-1 and 1-2 as IF1'−SI (F3), is 24. The difference F4 between F2' and S, expressed in Tables 1-1and 1-2 as IF2'−SI (F4), is 13. F3+F4 is 37.

As described above, in the racket frame 1 having the above-described construction, the fibrous angles of the prepregs are differentiated from one another. By forming the concavity 30 on the periphery of the inner peripheral-side string hole 20*a* at required positions of the head part 11 and by forming the string hole 20*a* on the bottom surface of the concavity 30, the secondary in-plane natural frequency F1 is set small, the secondary out-of-plane natural frequency F2 is set large, and F1/F2 is set to 0.42, when the string is not mounted on the racket frame 1.

Figure 3:
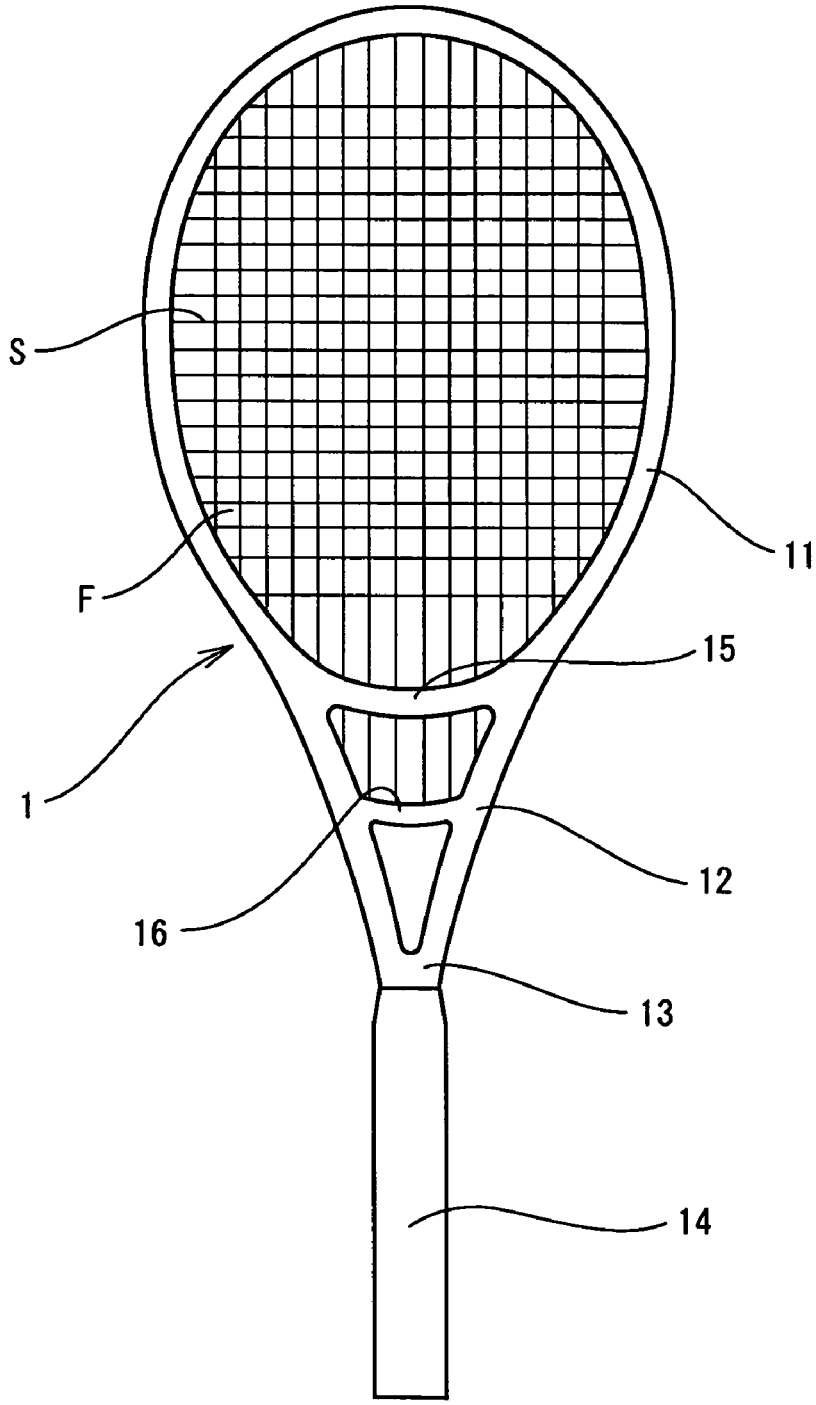
FIG. 3 is a front view showing a state where strings are mounted on the racket frame.

Therefore as shown in FIG. 3, it is possible to make the secondary in-plane natural frequency F1 and the secondary out-of-plane natural frequency F2 proximate to the natural frequency of the strings S when the strings S are mounted on the ball-hitting face F. Thereby it is possible to improve the restitution performance of the strings S.

The concavity 30 is formed around the inner peripheral-side string hole 20*a* of the string hole 20 disposed at the four corners of the ball-hitting face F, namely, at the 2 o'clock position, the 4 o'clock position, the 8 o'clock position, and the 10 o'clock position. Therefore it is possible to elongate the length of the inner periphery of the racket frame 1. Thereby it is possible to reduce the difference between the length of inner periphery of the racket frame 1 and that of the periphery thereof. Hence it is possible to prevent wrinkles from being formed in a molding time and the racket frame 1 from cracking. That is, it is possible to increase the strength of the racket frame 1. Therefore by forming the concavity 30, it is possible to adjust the secondary in-plane natural frequency and the secondary out-of-plane natural frequency without reducing the strength of the racket frame 1. Since the concavity is formed on the periphery of the inner peripheral-side string hole 20*a*, it is possible to elongate the substantial effective length of the string S passing through the inner peripheral-side string hole 20*a*. Therefore it is possible to enhance the restitution performance of the string inserted into the string holes 20 in the vicinity of the 2 o'clock position, the 4 o'clock position, the 8 o'clock position, and the 10 o'clock position. Thereby it is possible to enlarge the sweet area.

Examples 1 through 6 of the racket frame of the present invention and comparison examples 1 and 2 are described in detail below.

The racket frames of the examples 1 through 6 and the comparison examples 1 and 2 were identical to one another in the configurations thereof and had a length of 685 mm. The almost elliptic head part had a thickness of 28 mm in the out-of-plane direction and a width of 13 mm to 16 mm in the in-plane direction. The area of the ball-hitting face was set to 116 square inches.

The same material was used for the racket frames. The racket frames were formed by using the same method. CF prepregs (T-300, T-700, T-800, M46J manufactured by Toray Industries Inc.) were layered one upon another on a mandrel with φ14.5 mm on which an internal-pressure tube made of nylon 66 was fitted. The fibrous angles of the prepregs were 0°, 30°, and 45°.

Thereafter the tube was removed from the mandrel to prepare a layup, the lay-up was set in the cavity of a die. After the die was clamped, the die was heated to 150° C. for 30 minutes, with an air pressure of 9 kgf/cm$^2$ kept applied to the inside of the tube. Thereafter the tube was removed from the die. Thereby the pipe-shaped racket frame having a hollow portion was obtained. Thereafter a rib disposed in the length of 15 cm from one end of the racket was cut off.

TABLE 1-1

| | Example 1 | Example 2 | Example 3 | Example 4 |
|---|---|---|---|---|
| Mode of periphery of string hole | Elliptic (20 × 10) | Elliptic (20 × 10) | Elliptic (20 × 10) | Elliptic (20 × 10) |

TABLE 1-1-continued

| | | Example 1 | Example 2 | Example 3 | Example 4 |
|---|---|---|---|---|---|
| Depth of concavity | | 2 mm | 2 mm | 2 mm | 2 mm |
| Position of concavity | | 3 o'clock, 9 o'clock | 3 o'clock, 9 o'clock | 2 o'clock, 4 o'clock, 8 o'clock, 10 o'clock | 2 o'clock, 4 o'clock, 8 o'clock, 10 o'clock |
| weight ratio among prepregs having fibrous angles of 0°, 30°, 45° | | 4:1:5 | 2:6:2 | 2:3:5 | 2:4:4 |
| Weight (g) of racket frame | | 248 | 247 | 247 | 246 |
| Frame balance (mm) | | 360 | 360 | 361 | 360 |
| Rigidity | Rigidity (kgf/cm) of side of racket frame | 73 | 70 | 61 | 55 |
| (String was not mounted) | Rigidity (kgf/cm) of ball-hitting face | 195 | 165 | 175 | 180 |
| Natural frequency | Secondary in-plane direction (F1) (Hz) | 312 | 295 | 265 | 232 |
| (No string is mounted on racket frame) | Secondary out-of-plane direction (F2) (Hz) | 613 | 512 | 533 | 555 |
| | F1/F2 | 0.51 | 0.58 | 0.50 | 0.42 |
| Natural frequency | Secondary in-plane direction (F1') (Hz) | 625 | 612 | 580 | 550 |
| (String is mounted on racket frame) | Secondary out-of-plane direction (F2') (Hz) | 593 | 500 | 515 | 539 |
| | String (S) | 530 | 529 | 526 | 526 |
| | IF1'-SI (F3) | 95 | 83 | 54 | 24 |
| | IF2'-SI (F4) | 63 | 29 | 11 | 13 |
| | F3 + F4 | 168 | 112 | 65 | 37 |
| Restitution coefficient | | 0.442 | 0.445 | 0.447 | 0.451 |
| Evaluation by ball-hitting test | Flight distance | 4.0 | 4.1 | 4 1 | 4.3 |
| Breaking strength | Strength (kgf) of side of racket frame (kgf) | 162 | 159 | 153 | 149 |
| Durability | | ○0/6 | ○0/6 | ○0/6 | ○0/6 |

TABLE 1-2

| | | Example 5 | Example 6 | Comparison Example 1 | Comparison Example 2 |
|---|---|---|---|---|---|
| Mode of periphery of string hole | | Elliptic (20 × 10) | Elliptic (20 × 10) | | |
| Depth of concavity | | 4 mm | 4 mm | | |
| Position of concavity | | Between 2 o'clock and 4 o'clock, between 8 o'clock and 10 o'clock | Between 2 o'clock and 4 o'clock, between 8 o'clock and 10 o'clock | | |
| Weight ratio among prepregs having fibrous angles of 0°, 30°, 45° | | 2:5:3 | 2:3:5 | 2:8:0 | 2:2:6 |
| Weight(g) of racket frame | | 248 | 246 | 247 | 248 |
| Frame balance (mm) | | 361 | 359 | 361 | 360 |
| Rigidity | Rigidity (kgf/cm) of side of racket frame | 51 | 50 | 79 | 45 |
| (String was not mounted) | Rigidity (kgf/cm) of ball-hitting face | 163 | 187 | 145 | 210 |
| Natural frequency | Secondary in-plane direction (F1) (Hz) | 218 | 210 | 330 | 185 |
| (No string is mounted on racket frame) | Secondary out-of-plane direction (F2) (Hz) | 508 | 587 | 459 | 670 |
| | F1/F2 | 0.43 | 0.36 | 0.72 | 0.28 |
| Natural frequency | Secondary in-plane direction (F1') (Hz) | 537 | 529 | 650 | 505 |
| (String is mounted on racket frame) | Secondary out-of-plane direction (F2') (Hz) | 496 | 562 | 439 | 651 |
| | String (S) | 523 | 524 | 538 | 535 |
| | IF1'-SI (F3) | 14 | 5 | 112 | 30 |
| | IF2'-SI (F4) | 27 | 38 | 99 | 116 |
| | F3 + F4 | 41 | 43 | 211 | 146 |
| Restitution coefficient | | 0.450 | 0.450 | 0.435 | 0.443 |
| Evaluation by ball-hitting test | Flight distance | 4.2 | 4.3 | 3.6 | 4.1 |
| Breaking strength | Strength (kgf) of side of racket frame (kgf) | 145 | 140 | 169 | 126 |
| Durability | | ○0/6 | ○0/6 | ○0/6 | X2/6 |

EXAMPLE 1

An elliptic concavity was formed on the inner peripheral portion of the 3 o'clock position and the 9 o'clock position of the head part, and on the inner peripheral portion of positions, near the 3 o'clock position and the 9 o'clock position, where a string hole was to be formed. A string hole was formed on the bottom surface of each concavity. The major axis of the concavity, the minor axis thereof, and the depth thereof were set to 20 mm, 10 mm, and 2 mm respectively. The weight ratio among the prepregs having fibrous angles of 0°, 30°, and 45° was set to 4:1:5.

EXAMPLE 2

An elliptic concavity was formed on the inner peripheral portion of the 3 o'clock position and the 9 o'clock position of the head part, and on the inner peripheral portion of positions, near the 3 o'clock position and the 9 o'clock position, where a string hole was to be formed. A string hole was formed on the bottom surface of each concavity. The major axis of the concavity, the minor axis thereof, and the depth thereof were set to 20 mm, 10 mm, and 2 mm respectively. The weight ratio among the prepregs having fibrous angles of 0°, 30°, and 45° was set to 2:6:2.

EXAMPLE 3

An elliptic concavity was formed on the inner peripheral portion of the 2 o'clock position, the 4 o'clock position, 8 o'clock position, the 10 o'clock position of the head part and on the inner peripheral portion of positions, near these four positions, where a string hole was to be formed. A string hole was formed on the bottom surface of each concavity. The major axis of the concavity, the minor axis thereof, and the depth thereof were set to 20 mm, 10 mm, and 2 mm respectively. The weight ratio among the prepregs having fibrous angles of 0°, 30°, and 45° was set to 2:3:5.

EXAMPLE 4

The racket frame of the example 4 was similar to that of the embodiment. That is, a concavity was formed on the inner peripheral portion of positions near the 2 o'clock position, the 4 o'clock position, 8 o'clock position, the 10 o'clock position of the head part where a string hole was to be formed. A string hole was formed on the bottom surface of each concavity. The major axis of the concavity, the minor axis thereof, and the depth thereof were set to 20 mm, 10 mm, and 2 mm respectively. The weight ratio among the prepregs having fibrous angles of 0°, 30°, and 45° was set to 2:4:4.

EXAMPLE 5

A concavity was formed on the inner peripheral portion of a position between the 2 o'clock position of the head part and the 4 o'clock position thereof, a position between the 8 o'clock position of the head part and the 10 o'clock position thereof, and on the inner peripheral portion of positions, near these positions, where a string hole was to be formed. A string hole was formed on the bottom surface of each concavity. The major axis of the concavity, the minor axis thereof, and the depth thereof were set to 20 mm, 10 mm, and 4 mm respectively. The weight ratio among the prepregs having fibrous angles of 0°, 30°, and 45° was set to 2:5:3.

EXAMPLE 6

A concavity was formed on the inner peripheral portion of a position between the 2 o'clock position of the head part and the 4 o'clock position thereof, a position between the 8 o'clock position of the head part and the 10 o'clock position thereof, and on the inner peripheral portion of positions, near these positions, where a string hole was to be formed. A string hole was formed on the bottom surface of each concavity. The major axis of the concavity, the minor axis thereof, and the depth thereof were set to 20 mm, 10 mm, and 4 mm respectively. The weight ratio among the prepregs having fibrous angles of 0°, 30°, and 45° was set to 2:3:5.

COMPARISON EXAMPLE 1

The weight ratio among the prepregs having fibrous angles of 0°, 30°, and 45° was set to 2:8:0. A concavity was not formed on the inner peripheral portion of positions of the head part where a string hole was to be formed.

COMPARISON EXAMPLE 2

The weight ratio among the prepregs having fibrous angles of 0°, 30°, and 45° was set to 2:2:6. A concavity was not formed on the inner peripheral portion of positions of the head part where a string hole was to be formed.

The racket frame of each of the examples and the comparison examples was measured on the rigidity of the rigidity of the side face of the racket frame, the rigidity of its ball-hitting face, the secondary in-plane natural frequency and the secondary out-of-plane natural frequency when the string is not mounted on the ball-hitting face, the secondary in-plane natural frequency and the secondary out-of-plane natural frequency when the string is mounted on the ball-hitting face, the natural frequency of the string, the restitution coefficient, and the strength of the side face of the racket frame, and the durability of the racket frame. Further, evaluation was made on the restitution performance of each racket frame by hitting balls with each racket.

Measurement of Rigidity Value at Side of Racket Frame

Figure 4:
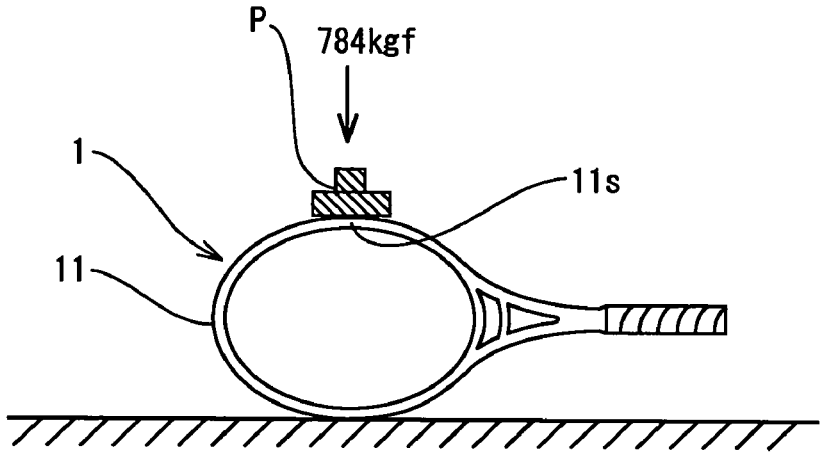
FIG. 4 is a schematic view showing a method of measuring the rigidity of a side face of the racket frame.

As shown in FIG. 4, the racket frame of each of the examples and the comparison examples was held sideways with a ball-hitting face kept vertical. In this state, a load of 784N was applied to an upper side face 11*s* of the head part 11 by means of a flat plate P. The spring constant was computed from a displaced-amount of the side face 11*s* at the load-applied time to obtain the rigidity value of the side of the racket frame under the load applied to the side face.

The load was applied to the upper side face 11*s* of the head part 11 by using a jig until breakage occurred. The value of the load was recorded when the breakage occurred to obtain the breaking strength of the side of the racket frame under the load applied to the side thereof.

Measurement of Rigidity of Ball-hitting Face

Figure 5:
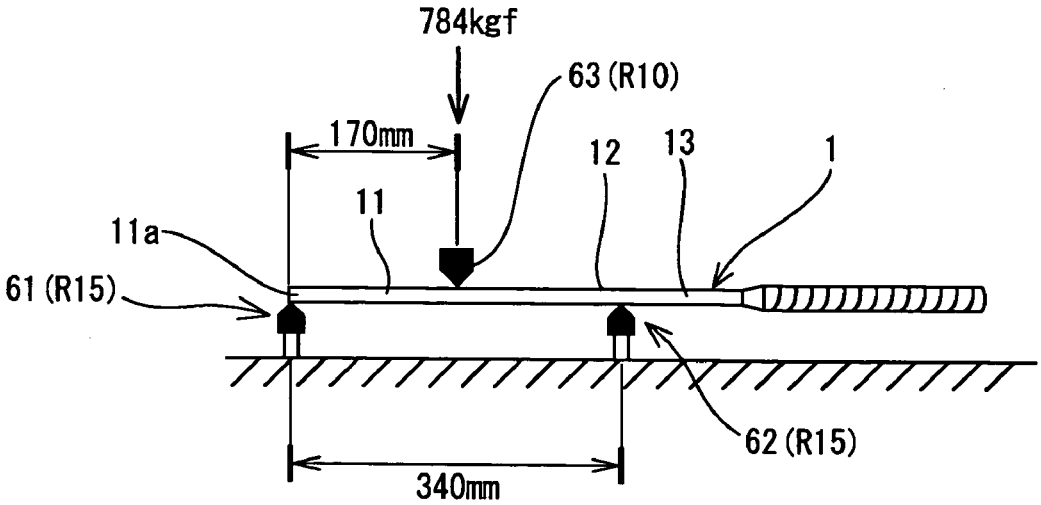
FIG. 5 is a schematic front view showing a method of measuring the rigidity of a ball-hitting plane.

As shown in FIG. 5, to measure the rigidity of the ball-hitting face (rigidity in out-of-plane direction), the string-stretched racket frame of each of the examples and the comparison examples was horizontally disposed. The top position 11*t* of the head part 11 was supported by a receiving jig 61 (R15). A position, spaced by 340 mm from the top position, which was located in the range between the throat part 12 and the first yoke 14 was supported by a receiving jig 62 (R15). In this state, a load of 784N was applied downward to a position spaced by 170 mm from the position of the receiving jig 61 by means of a pressurizing instrument 63 (R10). The spring constant was computed from a displaced amount of the ball-hitting face at the load-applied time to obtain the rigidity value thereof.

Measurement of Secondary In-plane Natural Frequency

Figures 6A, 6C, 6D:
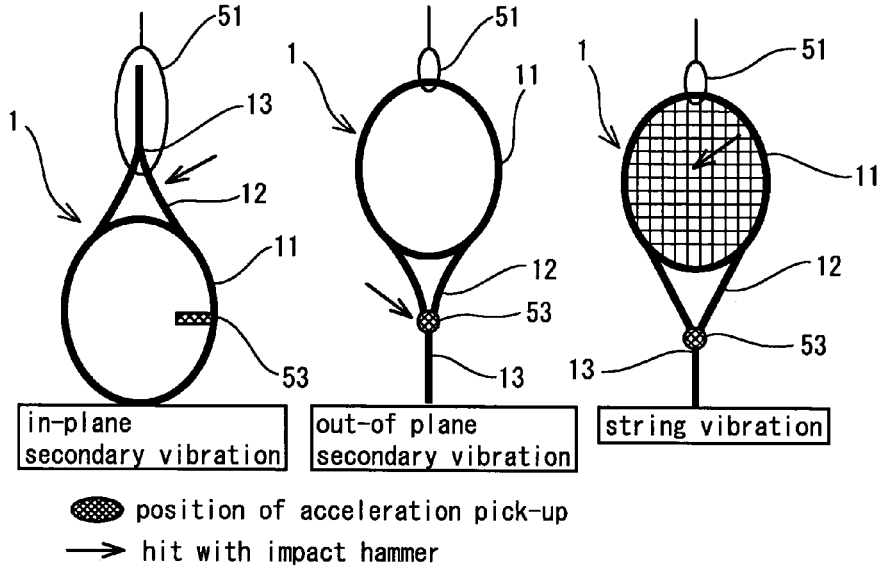
FIGS. 6A through 6D are schematic views showing the method of measuring the secondary in-plane direction natural frequency, secondary out-of-plane natural frequency, and string natural frequency of the racket frame.
Figure 6B:
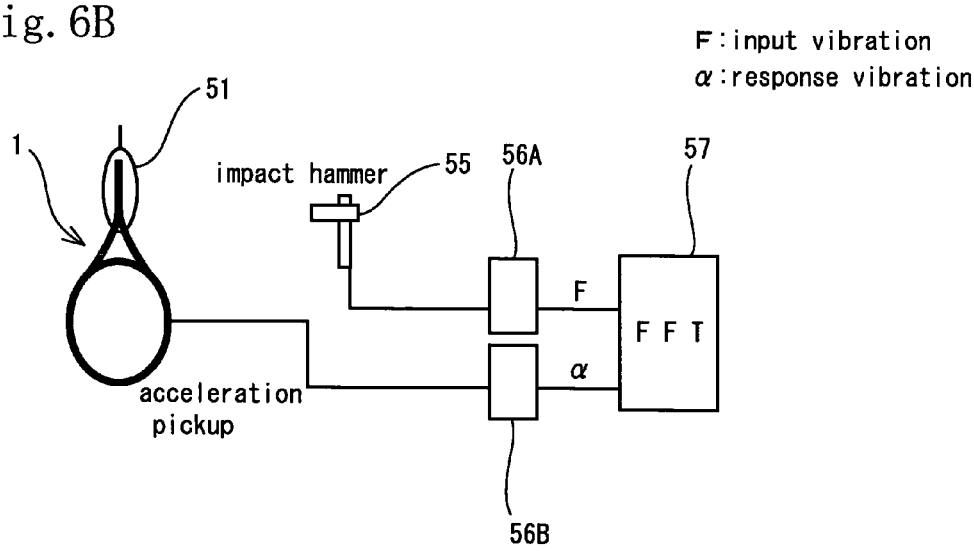

As shown in FIG. 6A, with the racket frame turned upside down, the confluence of the shaft part 13 and the throat part 12 was hung with a cord 51. An acceleration pick-up meter 53 was fixed to a maximum-width position of one side of the head part 11 with the acceleration pick-up meter 53 disposed parallel with the racket frame face (ball-hitting face). As shown in FIGS. 6B, in this state, the throat part 12 was hit with an impact hammer 55 to vibrate the racket frame. An input vibration (F) measured by a force pick-up meter mounted on the impact hammer 55 and a response vibration (α) measured by the acceleration pick-up meter 53 were inputted to a frequency analyzer 57 (dynamic single analyzer HP3562A manufactured by Fuhret Packard Inc.) through amplifiers 56A and 56B. A transmission function in a frequency region obtained by an analysis was calculated to obtain the frequency of the racket frame. In each of the examples and the comparison examples, the secondary in-plane natural frequency was measured when the string was mounted on the racket frame and when the string was not mounted thereon.

Measurement of Secondary Out-of-plane Natural Frequency

As shown in FIG. 6C, the upper end of the head part 11 of each of the examples and the comparison examples was hung with the cord 51. The acceleration pick-up meter 53 was mounted on one connection portion between the throat part 12 and the shaft part 13, with the acceleration pick-up meter 53 perpendicular to the face of the racket frame. In this state, the rear side of the pick-up meter-mounted position was hit with the impact hammer 55 to vibrate the tennis racket. The secondary out-of-plane natural frequency was computed by a method equivalent to the method of computing the secondary in-plane natural frequency. In each of the examples and the comparison examples, the secondary out-of-plane natural frequency was measured when the string was mounted on the racket frame and when the string was not mounted thereon.

Measurement of Natural Frequency of String

As shown in FIG. 6D, the upper end of the head part 11 of each of the examples and the comparison examples was hung with the cord 51, with the string mounted on the head part 11. The acceleration pick-up meter 53 was mounted on the confluence of the throat part 12 and the shaft part 13, with the acceleration pick-up meter 53 vertical to the face of the racket frame. In this state, the string disposed at the center of the head part 11 was hit with the impact hammer 55 to vibrate the tennis racket. The natural frequency of the string was computed by a method equivalent to the method of computing the secondary in-plane natural frequency.

Measurement of Restitution Coefficient

Figure 7:
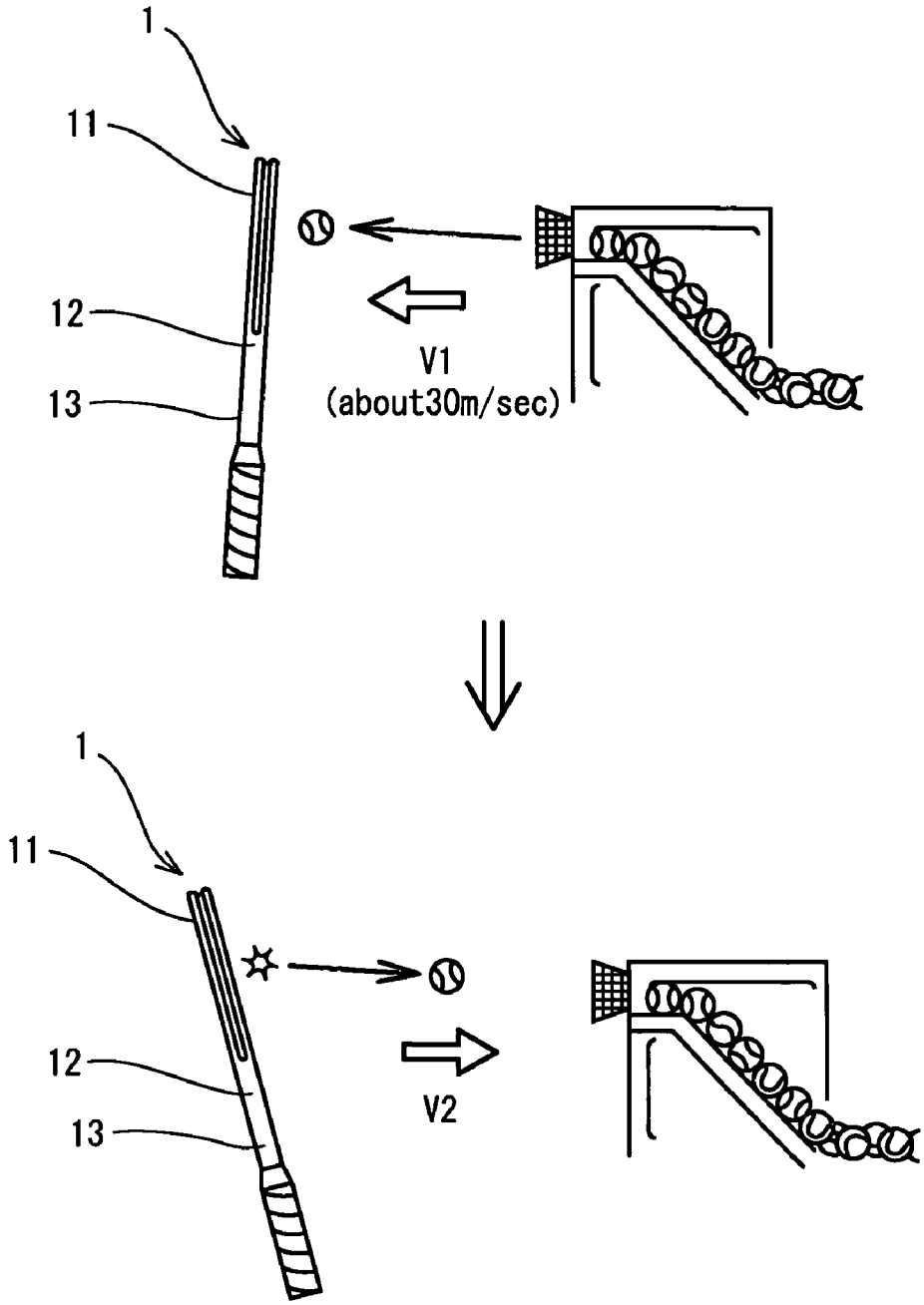
FIG. 7 is a schematic view showing a method of measuring the restitution coefficient of the racket frame.

As shown in FIG. 7, strings were mounted on the racket frame of each of the examples and comparison examples with a tensile force of 60 pounds in a vertical direction and 55 pounds in a horizontal direction. The grip part of each racket frame was fixed in such a way that each racket frame was free in a vertical direction. A tennis ball was launched from a ball launcher at a constant speed of V1 (30 m/sec) and collided with the ball-hitting face of the racket frame to measure the rebound speed V2 of the tennis ball. The restitution coefficient is obtained by computing the ratio of the rebound speed V2 to the launched speed V1 (V2/V1). The larger the restitution coefficient is, the longer the tennis ball it hit a longer distance. The restitution coefficient was measured in this manner.

Durability Test

Strings were mounted on the racket frame of each of the examples and comparison examples with a tensile force of 60 pounds in a vertical direction and 55 pounds in a horizontal direction. The grip part of the racket frame was fixed with the racket frame kept vertical. A ball was hit at a speed of 55 m/second against each racket frame at a position spaced by 18 cm from the top of the ball-hitting face thereof to check whether the racket frame was broken. Six racket frames were used in the experiment for each of the examples and comparison examples, and the number of broken racket frames was checked.

Evaluation of Restitution Performance by Ball-hitting Test 56 middle and high class female players (having not less than 10 year' experience and playing tennis three or more days a week currently) were requested to hit balls with the tennis racket of each of the examples and comparison examples and gave marks on the basis of five (racket frame obtained higher mark is superior to racket frame in restitution performance) on the restitution performance thereof. Table 1 shows the average of marks they gave.

As shown in table 1, the racket frames of the examples 1 through 6 had not less than 200 Hz nor more than 320 Hz in the secondary in-plane natural frequency (F1), not less than 480 Hz nor more than 650 Hz in the secondary out-of-plane natural frequency (F2), and not less than 0.3 nor more than 0.6 in the ratio of F1 to F2, when no strings were mounted on these racket frames. It could be confirmed that the racket frames of the examples 1 through 6 had high restitution performance when strings were mounted on the racket frames. This is because the secondary in-plane natural frequencies (F1') and the secondary out-of-plane natural frequencies (F2') of these racket frames could be made proximate to the natural frequency (S) of the string.

On the other hand, in he racket frame of the comparison example 1, the secondary in-plane natural frequency (F1) was 330 Hz which was comparatively high, the secondary out-of-plane natural frequency (F2) was 459 Hz which was comparatively low, and the ratio of F1 to F2 was 0.72, when no strings were mounted on the racket frame. It could be confirmed that the racket frame of the comparison example 1 had a very low restitution performance when strings were mounted on the racket frame. This is because the secondary in-plane natural frequencies (F1') and the secondary out-of-plane natural frequencies (F2') of the racket frame of the comparison example 1 could not be made proximate to the natural frequency (S) of the string.

In the racket frame of the comparison example 2, the secondary in-plane natural frequency (F1) was 185 Hz which was comparatively low, the secondary out-of-plane natural frequency (F2) was 670 Hz which was comparatively high, and the ratio of F1 to F2 was 0.28, when no strings were mounted on the racket frame. It could be confirmed that the racket frame of the comparison example 2 had a high restitution performance when strings were mounted on the racket frame, because the secondary in-plane natural frequencies (F1') was proximate to the natural frequency (S) of the string. It could be also confirmed that because the racket frame of the comparison example 2 had a low secondary in-plane natural frequency and a low rigidity in its side, the racket frame of the comparison example 2 had a low strength and an inferior durability.

The restitution performance of the racket frame of the comparison example 2 was evaluated as same as the previous test.

What is claimed is:

1. A tennis racket frame comprising a sleeve composed of a fiber reinforced resin, said tennis racket frame having a weight not less than 180 g nor more than 270 g, with the exception of a weight of strings;

wherein supposing that said strings are not mounted on a ball-hitting face surrounded with a head part of said racket frame, a secondary natural frequency (F1) of said racket frame in an in-plane direction thereof is set to not less than 210 Hz nor more than 312 Hz, a secondary natural frequency (F2) thereof in an out-of-plane direction thereof is set to not less than 508 Hz nor more than 613 Hz, and F1/F2 is set to not less than 0.36 nor more than 0.58.

2. The racket frame according to claim 1, wherein an elliptic or oblong concavity is formed at one or more portions of an inner peripheral portion of said head part in such a way that a maximum length of said concavity in a longitudinal direction of said racket frame is smaller than a maximum length thereof in a thickness direction of said racket frame orthogonal to said longitudinal direction.

3. The racket frame according to claim 2, wherein in combination with a yoke thereof, said concavity is formed at four corners of said head part forming an elliptic or oblong ball-hitting face.

4. The racket frame according to claim 3, wherein supposing that said ball-hitting face is regarded as a clock face and that a top position thereof is 12 o'clock, said concavity is formed at a 3 o'clock position, a 9 o'clock position, and positions adjacent to said 3 o'clock position and said 9 o'clock position.

5. The racket frame according to claim 3, wherein said concavity is formed on a periphery of a string hole, with said string hole disposed at a center of said concavity or/and said concavity is formed on an inner peripheral portion of said head part disposed between adjacent string holes.

6. The racket frame according to claim 2, wherein supposing that said ball-hitting face is regarded as a clock face and that a top position thereof is 12 o'clock, said concavity is formed at a 3 o'clock position, a 9 o'clock position, and positions adjacent to said 3 o'clock position and said 9 o'clock position.

7. The racket frame according to claim 6, wherein said concavity is formed on a periphery of a string hole, with said string hole disposed at a center of said concavity or/and said concavity is formed on an inner peripheral portion of said head part disposed between adjacent string holes.

8. The racket frame according to claim 2, wherein said concavity is formed on a periphery of a string hole, with said string hole disposed at a center of said concavity or/and said concavity is formed on an inner peripheral portion of said head part disposed between adjacent string holes.

* * * * *